US011328689B2

(12) United States Patent
Mito et al.

(10) Patent No.: US 11,328,689 B2
(45) Date of Patent: May 10, 2022

(54) DISPLAY APPARATUS, CONTROL METHOD THEREOF, AND STORAGE MEDIUM

(71) Applicant: CANON KABUSHIKI KAISHA, Tokyo (JP)

(72) Inventors: Koji Mito, Koza-gun (JP); Yasuo Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/995,622

(22) Filed: Aug. 17, 2020

(65) Prior Publication Data

US 2021/0056931 A1 Feb. 25, 2021

(30) Foreign Application Priority Data

Aug. 23, 2019 (JP) ..... JP2019-152797

(51) Int. Cl.
*G09G 5/10* (2006.01)
*G09G 3/36* (2006.01)

(52) U.S. Cl.
CPC ..... *G09G 5/10* (2013.01); *G09G 3/3688* (2013.01); *G09G 2320/0646* (2013.01); *G09G 2360/141* (2013.01); *G09G 2360/145* (2013.01)

(58) Field of Classification Search
CPC ..... G09G 5/10; G09G 3/3688; G09G 2320/0646; G09G 2360/141; G09G 2360/145
See application file for complete search history.

(56) References Cited

U.S. PATENT DOCUMENTS

2009/0046928 A1* 2/2009 Kwak ..... H04N 9/735 382/167
2012/0139885 A1* 6/2012 Iwasa ..... G09G 3/3426 345/207
2013/0057593 A1* 3/2013 Morishita ..... G09G 3/3413 345/690
2015/0124010 A1* 5/2015 Yamashita ..... G09G 3/344 345/697
2015/0325179 A1* 11/2015 Shibamiya ..... G09G 3/3426 345/690
2019/0371262 A1* 12/2019 Koo ..... G09G 3/3426

FOREIGN PATENT DOCUMENTS

JP 2008-051905 A 3/2008
JP 2015-215482 A 12/2015

* cited by examiner

*Primary Examiner* — Amare Mengistu
*Assistant Examiner* — Jennifer L Zubajlo
(74) *Attorney, Agent, or Firm* — Canon U.S.A., Inc. IP Division

(57) ABSTRACT

An apparatus that displays a display image based on data about an input image comprises a liquid crystal panel, a backlight including a plurality of light source units corresponding to a plurality of divided regions of the liquid crystal panel; and a controller configured to control each of the plurality of light source units, wherein the controller changes, based on a feature amount related to a luminance in a first region of the input image, a light emission luminance of a light source unit, among the plurality of light source units, corresponding to a second region different from the first region of the input image.

4 Claims, 28 Drawing Sheets

FIG.6A

| | | | | | | | | | | | |
|---|---|---|---|---|---|---|---|---|---|---|---|
| 4095 | 4095 | 0 | 0 | 0 | 0 | 0 | 0 | 0 | 0 | 0 | 0 |
| 4095 | 4095 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.6B

| | | | | | | | | | | | |
|---|---|---|---|---|---|---|---|---|---|---|---|
| 4095 | 3448 | 0 | 0 | 0 | 0 | 0 | 0 | 0 | 0 | 0 | 0 |
| 842 | 709 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.7A

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.7B

| | | | | | | | | | | | |
|---|---|---|---|---|---|---|---|---|---|---|---|
| 1024 | 1000 | 0 | 0 | 0 | 0 | 0 | 0 | 0 | 0 | 0 | 0 |
| 300 | 250 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.9A

| | | | | | | | | | | | |
|---|---|---|---|---|---|---|---|---|---|---|---|
| 4095 | 4095 | 0 | 0 | 0 | 0 | 0 | 0 | 0 | 0 | 4095 | 4095 |
| 4095 | 4095 | 0 | 0 | 0 | 0 | 0 | 0 | 0 | 0 | 4095 | 4095 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 4095 | 4095 | 0 | 0 | 0 | 0 | 0 | 0 | 0 | 0 | 4095 | 4095 |
| 4095 | 4095 | 0 | 0 | 0 | 0 | 0 | 0 | 0 | 0 | 4095 | 4095 |

FIG.9B

| | | | | | | | | | | | |
|---|---|---|---|---|---|---|---|---|---|---|---|
| 4095 | 3448 | 0 | 0 | 0 | 0 | 0 | 0 | 0 | 0 | 3448 | 4095 |
| 842 | 709 | 0 | 0 | 0 | 0 | 0 | 0 | 0 | 0 | 709 | 842 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 842 | 709 | 0 | 0 | 0 | 0 | 0 | 0 | 0 | 0 | 709 | 842 |
| 4095 | 3448 | 0 | 0 | 0 | 0 | 0 | 0 | 0 | 0 | 3448 | 4095 |

FIG.10A

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

FIG.10B

| | | | | | | | | | | | |
|---|---|---|---|---|---|---|---|---|---|---|---|
| 1024 | 1000 | 0 | 0 | 0 | 0 | 0 | 0 | 0 | 0 | 1000 | 1024 |
| 300 | 250 | 0 | 0 | 0 | 0 | 0 | 0 | 0 | 0 | 250 | 300 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 300 | 250 | 0 | 0 | 0 | 0 | 0 | 0 | 0 | 0 | 250 | 300 |
| 1024 | 1000 | 0 | 0 | 0 | 0 | 0 | 0 | 0 | 0 | 1000 | 1024 |

FIG.12A

| | | | | | | | | | | | |
|---|---|---|---|---|---|---|---|---|---|---|---|
| 1024 | 1024 | 0 | 0 | 0 | 0 | 0 | 0 | 0 | 0 | 0 | 0 |
| 1024 | 1024 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.12B

| | | | | | | | | | | | |
|---|---|---|---|---|---|---|---|---|---|---|---|
| 1024 | 862 | 0 | 0 | 0 | 0 | 0 | 0 | 0 | 0 | 0 | 0 |
| 210 | 178 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.13A

| | | | | | | | | | | | |
|---|---|---|---|---|---|---|---|---|---|---|---|
| 1024 | 1000 | 0 | 0 | 0 | 0 | 0 | 0 | 0 | 0 | 0 | 0 |
| 300 | 250 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.13B

| | | | | | | | | | | | |
|---|---|---|---|---|---|---|---|---|---|---|---|
| 1024 | 1000 | 0 | 0 | 0 | 0 | 0 | 0 | 0 | 0 | 0 | 0 |
| 300 | 250 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.15A

| | | | | | | | | | | | |
|---|---|---|---|---|---|---|---|---|---|---|---|
| 4095 | 4095 | 0 | 0 | 0 | 0 | 0 | 0 | 0 | 0 | 0 | 0 |
| 4095 | 4095 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 4095 | 4095 | 0 | 0 | 0 | 0 | 0 |
| 0 | 0 | 0 | 0 | 0 | 4095 | 4095 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.15B

| | | | | | | | | | | | |
|---|---|---|---|---|---|---|---|---|---|---|---|
| 4095 | 3448 | 0 | 0 | 0 | 0 | 0 | 0 | 0 | 0 | 0 | 0 |
| 842 | 709 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 2256 | 2256 | 0 | 0 | 0 | 0 | 0 |
| 0 | 0 | 0 | 0 | 0 | 2256 | 2256 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.16A

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.16B

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.20A

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.20B

| | | | | | | | | | | | |
|---|---|---|---|---|---|---|---|---|---|---|---|
| 1024 | 1024 | 0 | 0 | 0 | 0 | 0 | 0 | 0 | 0 | 0 | 0 |
| 1024 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.21A

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

FIG.21B

| | | | | | | | | | | | |
|---|---|---|---|---|---|---|---|---|---|---|---|
| 1024 | 1024 | 0 | 0 | 0 | 0 | 0 | 0 | 0 | 0 | 1024 | 1024 |
| 1024 | 1000 | 0 | 0 | 0 | 0 | 0 | 0 | 0 | 0 | 1000 | 1024 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 1024 | 1000 | 0 | 0 | 0 | 0 | 0 | 0 | 0 | 0 | 1000 | 1024 |
| 1024 | 1024 | 0 | 0 | 0 | 0 | 0 | 0 | 0 | 0 | 1024 | 1024 |

FIG.22A

| | | | | | | | | | | | |
|---|---|---|---|---|---|---|---|---|---|---|---|
| 1024 | 1000 | 0 | 0 | 0 | 0 | 0 | 0 | 0 | 0 | 0 | 0 |
| 300 | 250 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.22B

| | | | | | | | | | | | |
|---|---|---|---|---|---|---|---|---|---|---|---|
| 1024 | 1000 | 0 | 0 | 0 | 0 | 0 | 0 | 0 | 0 | 0 | 0 |
| 300 | 250 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.23A

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.23B

| | | | | | | | | | | | |
|---|---|---|---|---|---|---|---|---|---|---|---|
| 4096 | 4000 | 0 | 0 | 0 | 0 | 0 | 0 | 0 | 0 | 0 | 0 |
| 1200 | 1000 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG.25A

| | | | | | | | | | | | |
|---|---|---|---|---|---|---|---|---|---|---|---|
| 4095 | 4095 | 0 | 0 | 0 | 0 | 0 | 0 | 0 | 0 | 4095 | 4095 |
| 4095 | 4095 | 0 | 0 | 0 | 0 | 0 | 0 | 0 | 0 | 4095 | 4095 |
| 0 | 0 | 0 | 0 | 0 | 0 | 0 | 0 | 0 | 0 | 0 | 0 |
| 0 | 0 | 0 | 0 | 0 | 4095 | 4095 | 0 | 0 | 0 | 0 | 0 |
| 0 | 0 | 0 | 0 | 0 | 4095 | 4095 | 0 | 0 | 0 | 0 | 0 |
| 0 | 0 | 0 | 0 | 0 | 0 | 0 | 0 | 0 | 0 | 0 | 0 |
| 4095 | 4095 | 0 | 0 | 0 | 0 | 0 | 0 | 0 | 0 | 4095 | 4095 |
| 4095 | 4095 | 0 | 0 | 0 | 0 | 0 | 0 | 0 | 0 | 4095 | 4095 |

FIG.25B

| | | | | | | | | | | | |
|---|---|---|---|---|---|---|---|---|---|---|---|
| 4095 | 3448 | 0 | 0 | 0 | 0 | 0 | 0 | 0 | 0 | 3448 | 4095 |
| 842 | 709 | 0 | 0 | 0 | 0 | 0 | 0 | 0 | 0 | 709 | 842 |
| 0 | 0 | 0 | 0 | 0 | 0 | 0 | 0 | 0 | 0 | 0 | 0 |
| 0 | 0 | 0 | 0 | 0 | 2256 | 2256 | 0 | 0 | 0 | 0 | 0 |
| 0 | 0 | 0 | 0 | 0 | 2256 | 2256 | 0 | 0 | 0 | 0 | 0 |
| 0 | 0 | 0 | 0 | 0 | 0 | 0 | 0 | 0 | 0 | 0 | 0 |
| 842 | 709 | 0 | 0 | 0 | 0 | 0 | 0 | 0 | 0 | 709 | 842 |
| 4095 | 3448 | 0 | 0 | 0 | 0 | 0 | 0 | 0 | 0 | 3448 | 4095 |

FIG.26A

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

FIG.26B

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

FIG.27A

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

FIG.27B

| | | | | | | | | | | | |
|---|---|---|---|---|---|---|---|---|---|---|---|
| 4096 | 4000 | 0 | 0 | 0 | 0 | 0 | 0 | 0 | 0 | 4000 | 4096 |
| 1200 | 1000 | 0 | 0 | 0 | 0 | 0 | 0 | 0 | 0 | 1000 | 1200 |
| 0 | 0 | 0 | 0 | 0 | 0 | 0 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 3800 | 3800 | 0 | 0 | 0 | 0 | 0 |
| 0 | 0 | 0 | 0 | 0 | 0 | 0 | 0 | 0 | 0 | 0 | 0 |
| 1200 | 1000 | 0 | 0 | 0 | 0 | 0 | 0 | 0 | 0 | 1000 | 1200 |
| 4096 | 4000 | 0 | 0 | 0 | 0 | 0 | 0 | 0 | 0 | 4000 | 4096 |

DISPLAY APPARATUS, CONTROL METHOD THEREOF, AND STORAGE MEDIUM

BACKGROUND

Field of the Disclosure

The aspect of the embodiments relates to a display apparatus, a control method of the display apparatus, and a storage medium.

Description of the Related Art

With the widespread use of a high dynamic range (HDR), there is a demand for a display apparatus to display an image with high luminance and high contrast. For example, the Society of Motion Picture and Television Engineers (SMPTE) ST 2084 standards define display with a maximum gradation of 10000 nits (cd/m$^2$). However, the current display apparatuses have a peak luminance of 1000 to 2000 nits at most. An image to be displayed on a display apparatus with a peak luminance or higher is generally clipped and displayed.

By contrast, in a liquid crystal display apparatus, the contrast can be improved by local dimming control. The local dimming control is a technique for controlling a light emission luminance of a backlight for irradiating a liquid crystal panel with light for each divided region based on a feature amount (an average picture level (APL) or a maximum picture level) related to the luminance in image data input to a liquid crystal display apparatus. Further, in the liquid crystal display apparatus, display with high luminance is achieved by increasing the light emission luminance of the backlight.

In local dimming control, the backlight of each divided region is caused to emit light, so that the light is diffused to a peripheral area of each divided region. Accordingly, in the region where diffused light is arrived, a black level fluctuation occurs due to leakage of light from the liquid crystal panel. In many cases, the backlight is covered with a reflecting plate so as to enhance the utilization efficiency of light on the back surface and side surfaces of the backlight. In such a case, when the backlight of each of the divided regions at screen ends is caused to emit light, reflected light from the side surfaces is added and thus light is more likely to be diffused. In other words, in the case of displaying an object with high luminance at screen ends, the backlights located at screen ends are caused to emit light with high luminance Thus, diffused light reaches the region, such as a central portion of the screen, which is distant from the screen ends, and thus the black level fluctuation is likely to occur also in the region distant from screen ends, such as the central portion of the screen.

As a local dimming control technique, a technique in which a region on which information is displayed is detected from image data and a luminance value in the image data is corrected so as to increase a display luminance in the detected region is known, as discussed in Japanese Patent Laid-Open No. 2015-215482.

In the case described above, the black level fluctuation in a portion, for example, a central portion of the screen, can be reduced through control of an increase in the luminance of each backlight at screen ends. However, if such an increase in the luminance of each backlight at screen ends is controlled, the display luminances at screen ends are decreased. While the black level fluctuation is conspicuous with low display luminance in the central portion of the screen, the black level fluctuation is not conspicuous with high display luminance in the central portion of the screen. Thus, even if an increase in the luminance of each backlight at screen ends is controlled in a case where the display luminance in the central portion of the screen is high, only the display luminances at screen ends are decreased, which may have an adverse effect on the quality of a display image.

SUMMARY OF THE DISCLOSURE

According to a first aspect of the embodiments, there is provided an apparatus that displays a display image based on data about an input image, the apparatus comprising: a liquid crystal panel; a backlight including a plurality of light source units corresponding to a plurality of divided regions of the liquid crystal panel; and a controller configured to control each of the plurality of light source units, wherein the controller changes, based on a feature amount related to a luminance in a first region of the input image, a light emission luminance of a light source unit, among the plurality of light source units, corresponding to a second region different from the first region of the input image.

According to a second aspect of the embodiments, there is provided an apparatus that displays a display image based on data about an input image, the apparatus comprising: a controller configured to perform local dimming control based on the data about the input image, wherein, in a case where the input image is a black image in which white boxes each having an area corresponding to approximately 2.5% of the input image are arranged at a central portion of the input image and at four corners of the input image, the controller displays, with a first display luminance, regions at four corners of the display image corresponding to the white boxes at the four corners of the input image, and wherein, in a case where the input image is a black image in which the white boxes are arranged at the four corners of the input image, the controller displays the regions at the four corners of the display image with a second display luminance lower than the first display luminance.

According to a third aspect of the embodiments, there is provided a method for controlling an apparatus that displays a display image based on data about an input image, the apparatus comprising a liquid crystal panel, and a backlight including a plurality of light source units corresponding to a plurality of divided regions of the liquid crystal panel, the method comprising: controlling each of the plurality of light source units, wherein, based on a feature amount related to a luminance in a first region of the input image, a light emission luminance of a light source unit, among the plurality of light source units, corresponding to a second region different from the first region of the input image is changed.

According to a fourth aspect of the embodiments, there is provided a method for controlling an apparatus that displays a display image based on data about an input image, the method comprising: performing local dimming control based on the data about the input image, wherein, in a case where the input image is a black image in which white boxes each having an area corresponding to approximately 2.5% of the input image are arranged at a central portion of the input image and at four corners of the input image, regions at four corners of the display image corresponding to the white boxes at the four corners of the input image are displayed with a first display luminance, and wherein, in a case where the input image is a black image in which the white boxes are arranged at the four corners of the input image, the regions at the four corners of the display image are displayed with a second display luminance lower than the first display luminance.

Further features of the disclosure will become apparent from the following description of exemplary embodiments with reference to the attached drawings.

BRIEF DESCRIPTION OF THE DRAWINGS

FIG. 6A is a schematic diagram illustrating a maximum picture level of data about the first input image, and FIG. 6B is a schematic diagram illustrating an average picture level of data about the first input image.

FIG. 7A is a schematic diagram illustrating a backlight control value (before adjustment) for displaying the first input image according to the first exemplary embodiment, and FIG. 7B is a schematic diagram illustrating a backlight control value (after adjustment) for displaying the first input image according to the first exemplary embodiment.

FIG. 9A is a schematic diagram illustrating a maximum picture level of data on the second input image, and FIG. 9B is a schematic diagram illustrating an average picture level of data about the second input image.

FIG. 10A is a schematic diagram illustrating a backlight control value (before adjustment) for displaying the second input image according to the first exemplary embodiment, and FIG. 10B is a schematic diagram illustrating a backlight control value (after adjustment) for displaying the second input image according to the first exemplary embodiment.

FIG. 12A is a schematic diagram illustrating a maximum picture level of data about the third input image, and FIG. 12B is a schematic diagram illustrating an average picture level of data about the third input image.

FIG. 13A is a schematic diagram illustrating a backlight control value (before adjustment) for displaying the third input image according to the first exemplary embodiment, and FIG. 13B is a schematic diagram illustrating a backlight control value (after adjustment) for displaying the third input image according to the first exemplary embodiment.

FIG. 15A is a schematic diagram illustrating a maximum picture level of data about the fourth input image, and FIG. 15B is a schematic diagram illustrating an average picture level of data about the fourth input image.

FIG. 16A is a schematic diagram illustrating a backlight control value (before adjustment) for displaying the fourth input image according to the first exemplary embodiment, and FIG. 16B is a schematic diagram illustrating a backlight control value (after adjustment) for displaying the fourth input image according to the first exemplary embodiment.

FIG. 20A is a schematic diagram illustrating a backlight control value (before adjustment) for displaying the first input image according to the second exemplary embodiment, and FIG. 20B is a schematic diagram illustrating a backlight control value (after adjustment) for displaying the first input image according to the second exemplary embodiment.

FIG. 21A is a schematic diagram illustrating a backlight control value (before adjustment) for displaying the second input image according to the second exemplary embodiment, and FIG. 21B is a schematic diagram illustrating a backlight control value (after adjustment) for displaying the second input image according to the second exemplary embodiment.

FIG. 22A is a schematic diagram illustrating a backlight control value (before adjustment) for displaying the third input image according to the second exemplary embodiment, and FIG. 22B is a schematic diagram illustrating a backlight control value (after adjustment) for displaying the third input image according to the second exemplary embodiment.

FIG. 23A is a schematic diagram illustrating a backlight control value (before adjustment) for displaying the fourth input image according to the second exemplary embodiment, and FIG. 23B is a schematic diagram illustrating a backlight control value (after adjustment) for displaying the fourth input image according to the second exemplary embodiment.

FIG. 25A is a schematic diagram illustrating a maximum picture level of data about the fifth input image, and FIG. 25B is a schematic diagram illustrating an average picture level of data about the fifth input image.

FIG. 26A is a schematic diagram illustrating a backlight control value (before adjustment) for displaying the fifth input image according to the first exemplary embodiment, and FIG. 26B is a schematic diagram illustrating a backlight control value (after adjustment) for displaying the fifth input image according to the first exemplary embodiment.

FIG. 27A is a schematic diagram illustrating a backlight control value (before adjustment) for displaying the fifth input image according to the second exemplary embodiment, and FIG. 27B is a schematic diagram illustrating a backlight control value (after adjustment) for displaying the fifth input image according to the second exemplary embodiment.

DESCRIPTION OF THE EMBODIMENTS

Exemplary embodiments of the disclosure will be described below with reference to the accompanying drawings. The technical scope of the disclosure is defined in the claims and is not limited by the following exemplary embodiments. Further, not all combinations of features described in the exemplary embodiments are essential for the disclosure. Details of descriptions in the present specification and the drawings are illustrative and should not be construed as limiting the disclosure. Various modifications can be made within the scope of the disclosure, and the modifications are not excluded from the scope of the disclosure. In other words, combined configurations of the embodiments and the modifications are all included in the disclosure.

First Exemplary Embodiment

A first exemplary embodiment of the disclosure will be described below.

Figure 1:
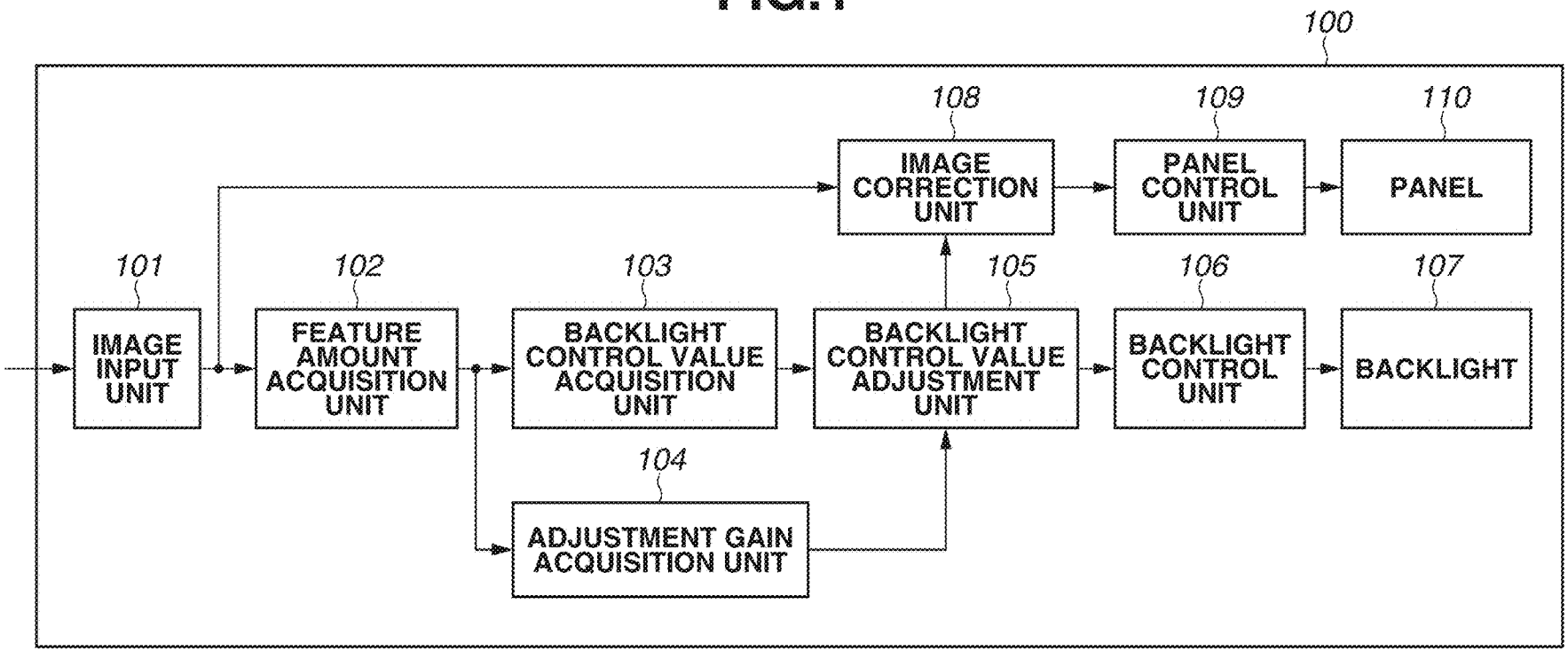
FIG. 1 is a block diagram illustrating a liquid crystal display apparatus according to a first exemplary embodiment.
Figure 28:
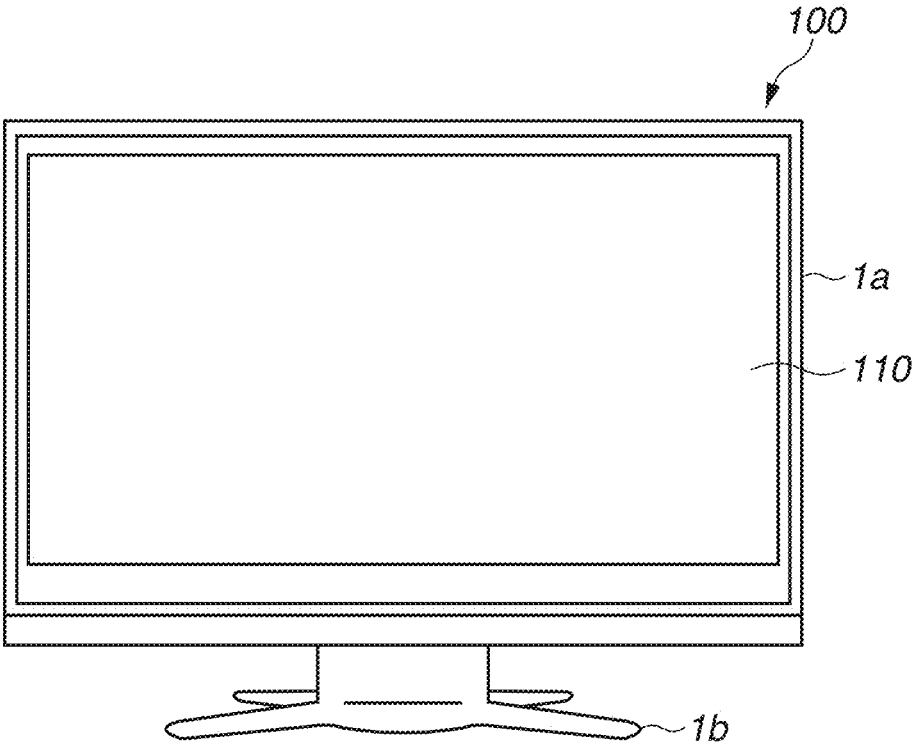
FIG. 28 is a front view of an appearance of the liquid crystal display apparatus.

FIG. 1 is a block diagram illustrating a display apparatus 100. FIG. 28 is a front view illustrating an appearance of the display apparatus 100. The display apparatus 100 includes a backlight 107, a panel 110, and a controller that controls display of the display apparatus 100. The controller includes an image input unit 101, a feature amount acquisition unit 102, a backlight control value acquisition unit 103, an adjustment gain acquisition unit 104, a backlight control value adjustment unit 105, a backlight control unit 106, an image correction unit 108, and a panel control unit 109. The display apparatus 100 further includes a chassis 1*a* that accommodates these members, and a stand 1*b* that allows the chassis 1*a* to stand upright. The image input unit 101, the feature amount acquisition unit 102, and the image correction unit 108 are configured with a dedicated circuit module. The backlight control value acquisition unit 103, the adjustment gain acquisition unit 104, the backlight control value adjustment unit 105, the backlight control unit 106, the image correction unit 108, and the panel control unit 109 are functional blocks which are executed by at least one central processing unit (CPU) reading out programs and executing the programs. All the units included in the controller may be configured with functional blocks which are executed by at least one CPU reading out programs from a memory and executing the programs.

The image input unit 101 acquires data about an image (input image) from an external apparatus. Examples of the external apparatus include an image capturing apparatus and a reproduction apparatus.

Figure 3A:
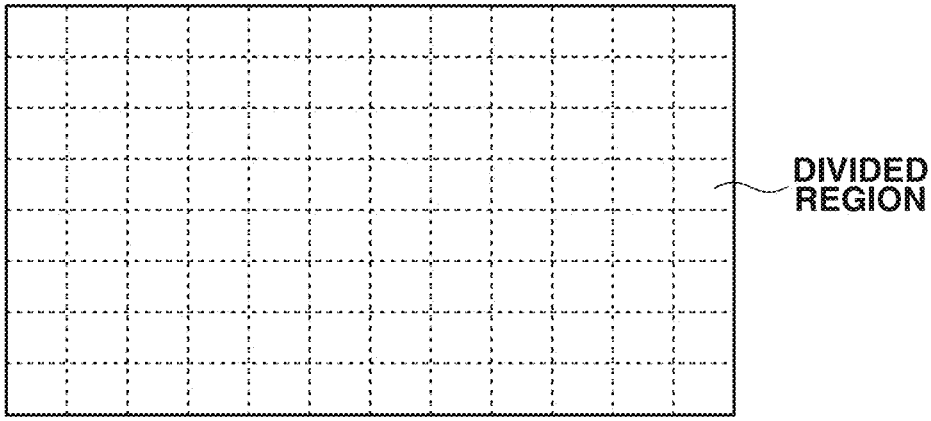
FIG. 3A is a schematic diagram illustrating divided regions.

The feature amount acquisition unit 102 acquires a feature amount, such as a maximum picture level and an average picture level, in image data acquired by the image input unit 101. The term "maximum picture level" refers to a maximum value of red (R), green (G), and blue (B) values in a pixel belonging to a certain region. More specifically, a maximum gradation value (code value) in RGB values is treated as the maximum picture level, without distinguishing the R, G, and B values from each other. The term "average picture level" refers to an average value of RGB values in a pixel belonging to a certain region. More specifically, an average of all gradation values in RGB values is used as the average picture level, without distinguishing the R, G, and B values from each other. FIG. 3A is a schematic diagram illustrating divided regions. In the present exemplary embodiment, the maximum picture level and the average picture level are acquired for each divided region illustrated in FIG. 3A. FIG. 3A illustrates that a screen (panel 110) of the display apparatus 100 is divided into 96 divided regions of 8 rows×12 columns. The region from which the feature amount is acquired is not limited to a divided region. The feature amount may be acquired from the entire screen, or may be acquired from a region other than the entire screen. The number of divided regions may be more than 96 or less than 96.

The backlight control value acquisition unit 103 generates a backlight control value for controlling the backlight 107 for each divided region illustrated in FIG. 3A based on the feature amount in image data acquired by the feature amount acquisition unit 102. More specifically, the backlight control value is obtained by adjusting a maximum image level with a coefficient corresponding to the average picture level for each divided region.

The adjustment gain acquisition unit 104 calculates an adjustment gain for the backlight control value generated by the backlight control value acquisition unit 103 based on the feature amount in the image data acquired by the feature amount acquisition unit 102.

The backlight control value adjustment unit 105 adjusts the backlight control value by multiplying the backlight control value generated by the backlight control value acquisition unit 103 by the adjustment gain calculated by the adjustment gain acquisition unit 104. The backlight control value adjusted by the backlight control value adjustment unit 105 is sent to the backlight control unit 106.

The backlight control unit 106 adjusts a light emission luminance of each light emitting diode (LED) included in the backlight 107 by pulse width modulation (PWM) control for each divided region illustrated in FIG. 3A. A duty ratio for PWM control is determined based on the backlight control value obtained based on each of the backlight control value acquisition unit 103 and the backlight control value adjustment unit 105.

The backlight 107 is a light source that applies light from the back surface of the panel 110. The backlight 107 includes a light source unit including a plurality of LEDs for each divided region. The backlight 107 is configured so as to control the plurality of light source units individually.

The image correction unit 108 corrects the image data acquired by the image input unit 101 based on the backlight control value adjusted by the backlight control value adjustment unit 105. More specifically, when the backlight control value adjusted by the backlight control value adjustment unit 105 is 0.5 times the backlight control value generated by the backlight control value acquisition unit 103, the image correction unit 108 multiplies the RGB values of the image data by a correction gain of 1/0.5=2. In this case, however, the image correction unit 108 adjusts the correction gain so that the RGB values of the image data do not exceed the maximum gradation value. More specifically, when the maximum value of RGB values in a certain pixel of image data is 930 and the maximum gradation value is 1023, 1023/930=1.1 is set to an upper limit for the correction gain. This configuration makes it possible to prevent a color change caused by a change in the balance among the R-value, the G-value, and the B-value due to a saturation of any one of the R-value, G-value, and the B-value. The image correction unit 108 can also correct the image data acquired by the image input unit 101 based on the backlight control value generated by the backlight control value acquisition unit 103 without taking into consideration the adjustment gain.

The panel control unit 109 controls the transmittance of the panel 110 so that an image based on the corrected image data output from the image correction unit 108 is displayed on the panel 110.

The panel 110 is a liquid crystal panel on which a display image is displayed on a screen under the control of the panel control unit 109.

Figure 2:
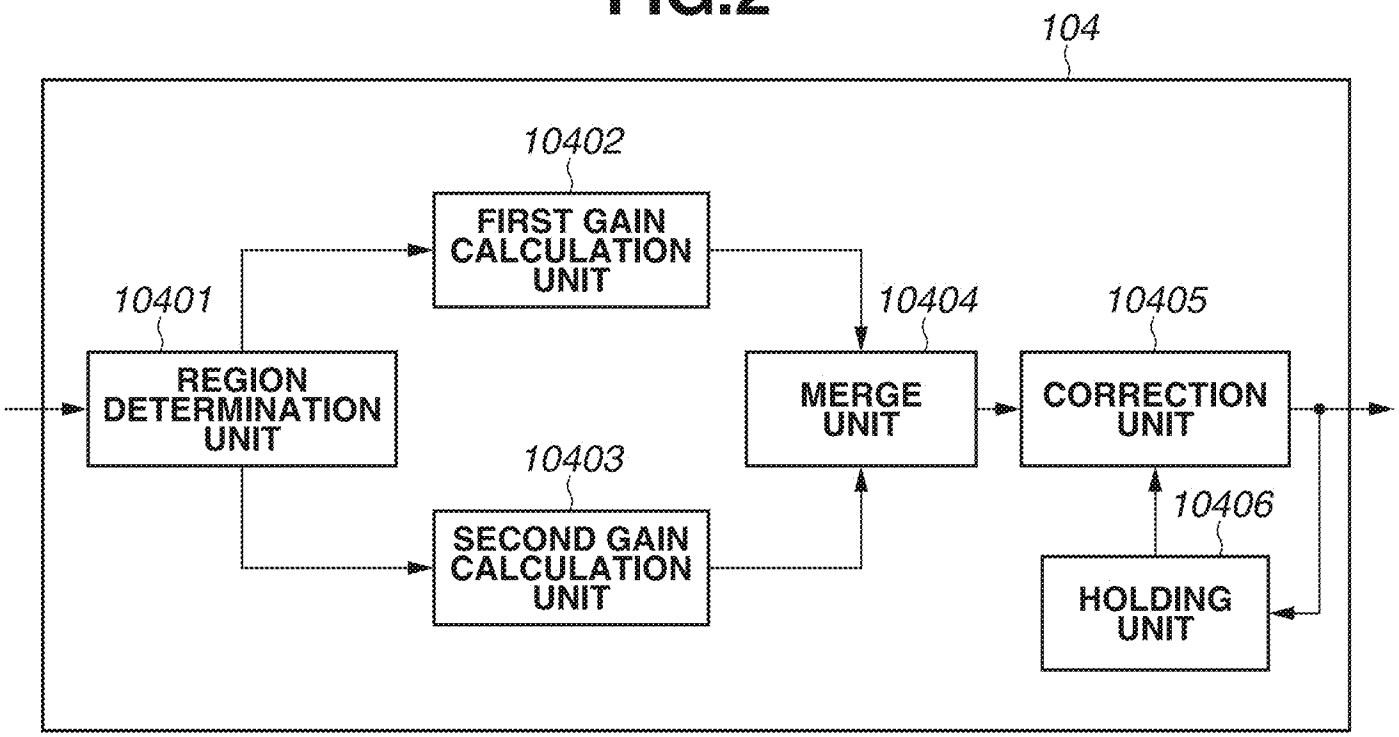
FIG. 2 is a block diagram illustrating functional blocks of an adjustment gain acquisition unit according to the first exemplary embodiment.

FIG. 2 is a block diagram illustrating functional blocks of the adjustment gain acquisition unit 104.

Figure 3B:
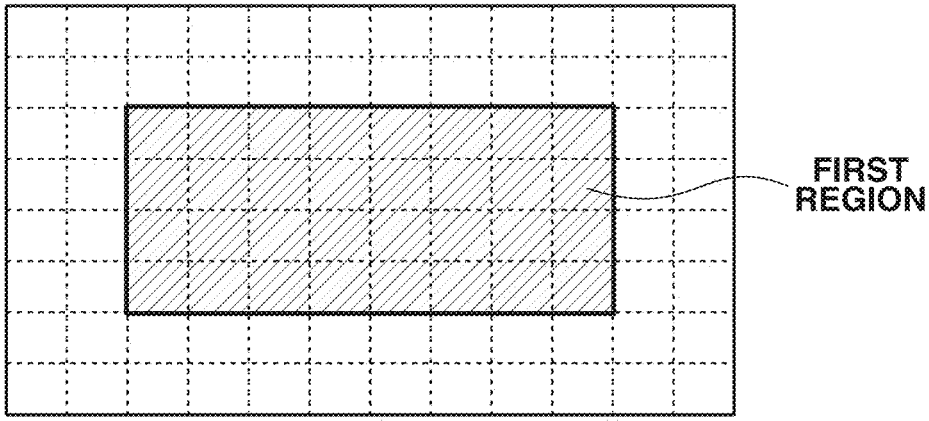
FIG. 3B is a schematic diagram illustrating a first region.
Figure 3C:
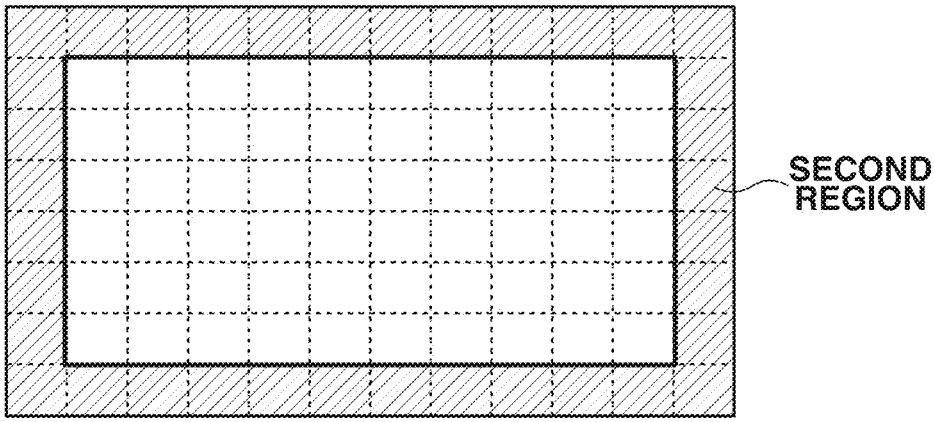
FIG. 3C is a schematic diagram illustrating a second region.

A region determination unit 10401 determines whether each of the divided regions from which the feature amount is acquired by the feature amount acquisition unit 102 illustrated in FIG. 1 corresponds to a first region or a second region. The feature amount acquisition unit 102 acquires the feature amount from image data using each divided region defined by a dashed line in FIG. 3A as one unit. If the divided region is included in a central region (first region), which is indicated by a shaded portion in FIG. 3B, in the panel 110, the region determination unit 10401 determines the divided region to be the first region. If the divided region is included in a peripheral region (second region), which is indicated by a shaded portion in FIG. 3C, in the panel 110, the region determination unit 10401 determines the divided region to be the second region. FIG. 3B is a schematic diagram illustrating the first region. FIG. 3C is a schematic diagram illustrating the second region. The first region and the second region are not limited to the regions illustrated in FIGS. 3B and 3C, respectively, and are not limited to the central region and the peripheral region, respectively. Any regions may be used as the first region and the second region, as long as the first region and the second region are different regions.

Figure 4A:
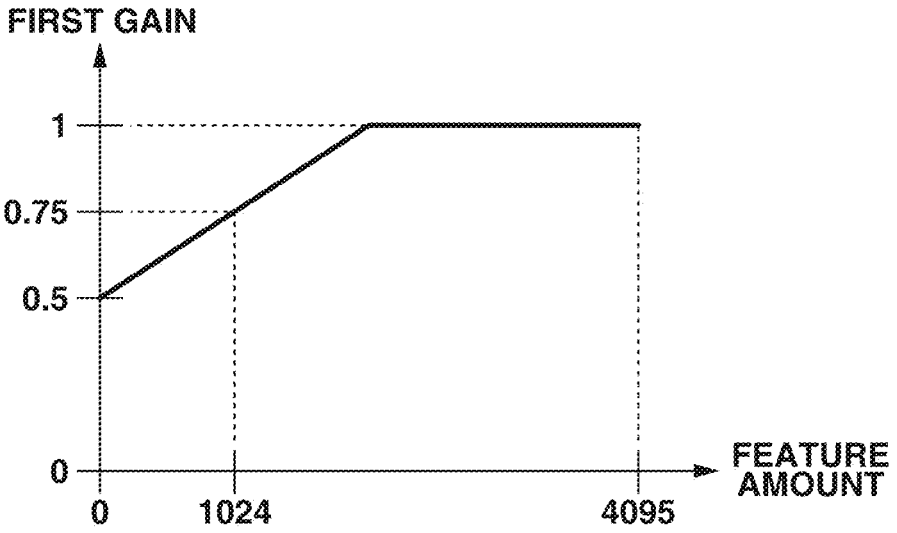
FIGS. 4A and 4B are graphs each schematically illustrating a relationship between a feature amount of image data and an adjustment gain of a backlight control value.

A first gain calculation unit 10402 calculates a first gain based on the feature amount in the divided region determined to be the first region by the region determination unit 10401. Here, the black level fluctuation is to be reduced in the first region. Thus, the first gain is set to a smaller value as the feature amount in the first region decreases, as illustrated in FIG. 4A. The feature amount to be used by the first gain calculation unit 10402 is the maximum picture level in the entire first region, i.e., the maximum value of the maximum picture level in the divided region determined to be the first region. The calculation of the first gain based on the maximum picture level in the entire first region makes it possible to control a decrease in a first adjustment gain, that is, a decrease in a display luminance at a bright point in a case where bright points, such as those in the starry sky, are present in the first region. The feature amount in the image data used for calculating the first gain is not limited to this example. Alternatively, for example, the average picture level in the entire first region, or the maximum value of the average picture level in the divided region determined to be the first region may be used.

Figure 4B:
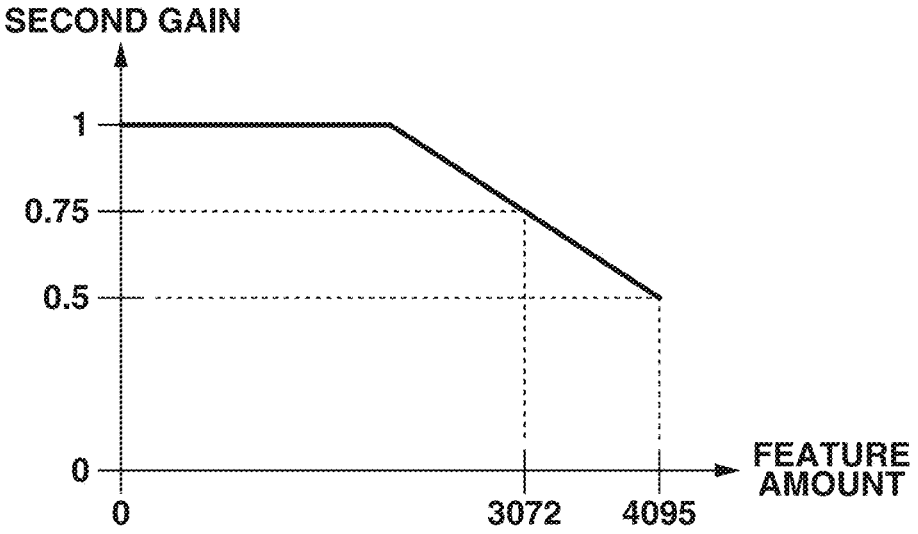

A second gain calculation unit 10403 calculates a second gain based on the feature amount in the divided region determined to be the second region by the region determination unit 10401. Here, the luminance is to be reduced in the second region. Thus, the second gain is set to a smaller value as the feature amount in the second region increases, as illustrated in FIG. 4B. The feature amount to be used by the second gain calculation unit 10403 is the maximum value of the average picture level in the divided region determined to be the second region. The second gain is calculated based on the maximum value of the average picture level, thus decreasing the second gain, i.e., decreasing the display luminance as the area of a high-luminance portion increases. The feature amount in the image data used for calculating the second gain is not limited to this example. Alternatively, for example, the maximum picture level or the average picture level in the entire second region may be used.

A merge unit 10404 multiplies the second gain calculated by the second gain calculation unit 10403 by the first gain calculated by the first gain calculation unit 10402, thus calculating the adjustment gain for the backlight control value. More specifically, in a case where the first gain is represented by Gain1 and the second gain is represented by Gain2, an adjustment gain curGain is calculated in accordance with the following Formula (1). In Formula (1), each of Gain1, Gain2, and curGain is regarded as a multiplier of one for 1.0. However, if either Gain1 or Gain2 is 1.0, curGain is set to 1.0, regardless of Formula (1).

$$curGain = Gain1 \times Gain2 \quad (1)$$

A correction unit 10405 corrects the adjustment gain calculated by the merge unit 10404 to control a rapid change in the adjustment gain. More specifically, in a case where the adjustment gain calculated by the merge unit 10404 is represented by curGain, the previous adjustment gain is represented by preGain, and a correction coefficient is represented by Coe, a corrected adjustment gain Gain is calculated by using Formula (2). The previous adjustment gain is held by a holding unit 10406. In Formula (2), each of curGain, preGain, Coe, and Gain is regarded as a multiplier of one for 1.0. The calculation for correcting the adjustment gain is not limited to Formula (2). Any calculation may be used as long as the adjustment gain can be changed moderately.

$$Gain = curGain - (curGain - preGain) \times Coe \quad (2)$$

A specific example of the gain adjustment for the backlight control value will be described.

Figure 5:
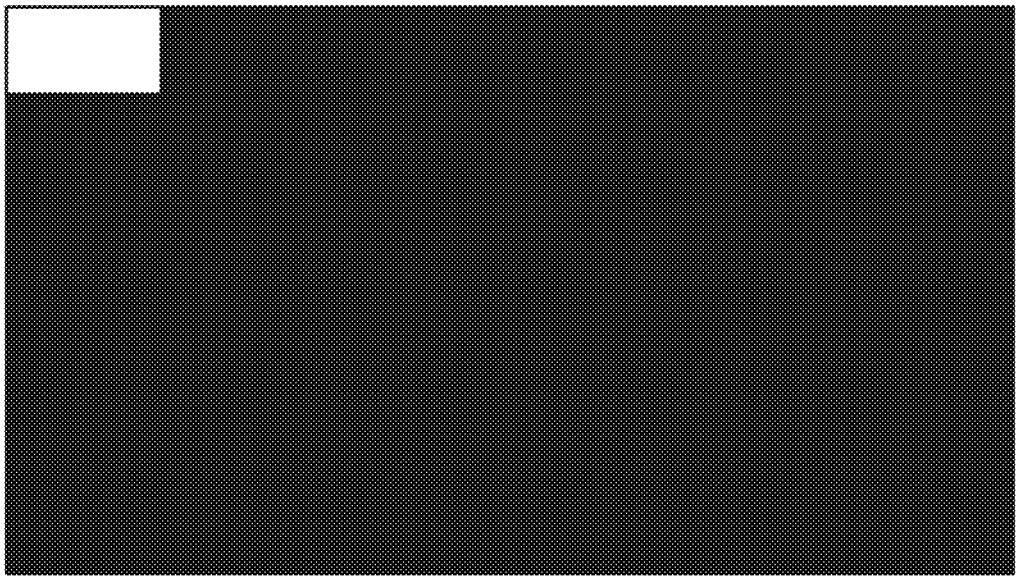
FIG. 5 is a schematic diagram illustrating a first input image input to the liquid crystal display apparatus.

FIG. 5 illustrates an input image in which a white box having a 2.5% area is arranged at upper left of a black image. FIG. 6A illustrates an example of values obtained by acquiring the maximum picture level of the image illustrated in FIG. 5 for each divided region. In the present exemplary embodiment, 12-bit gradation values 0 to 4095 are used as RGB values. The term "black image" indicates an image in which RGB values in each pixel of the image correspond to black (e.g., (0, 0, 0) for a full range). The term "white box" (white patch) indicates an image in which RGB values in each pixel of the region correspond to white (e.g., (4095, 4095, 4095) for a full range). As seen from FIG. 6A, the maximum picture level in the region corresponding to the shaded portion (first region) illustrated in FIG. 3B is "0". Accordingly, the first gain of 0.5 is calculated based on a graph illustrated in FIG. 4A. FIG. 6B illustrates an example of values obtained by acquiring the average picture level of the image illustrated in FIG. 5 for each divided region. As seen from FIG. 6B, the average picture level in the divided regions included in the region corresponding to the shaded portion (second region) illustrated in FIG. 3C is in a range from 0 to 4095, and the maximum value is 4095. Accordingly, the second gain of 0.5 is calculated based on a graph illustrated in FIG. 4B. Thus, the adjustment gain is calculated by 0.5 (first gain)×0.5 (second gain)=0.25 in accordance with Formula (1).

FIG. 7A illustrates an example of the backlight control values for displaying the input image illustrated in FIG. 5. The adjusted backlight control values illustrated in FIG. 7B are obtained through multiplication of the backlight control value illustrated in FIG. 7A by the adjustment gain of 0.25. Thus, in a case where the backlight light emission luminance at an end of the screen is high, the backlight light emission luminance is decreased, thus controlling the amount of diffused light from the end of the screen. Any value can be used as the backlight control value illustrated in FIG. 7A, as long as the input image illustrated in FIG. 5 can be displayed with a desired luminance, and the calculation method is not particularly limited.

Figure 8A:
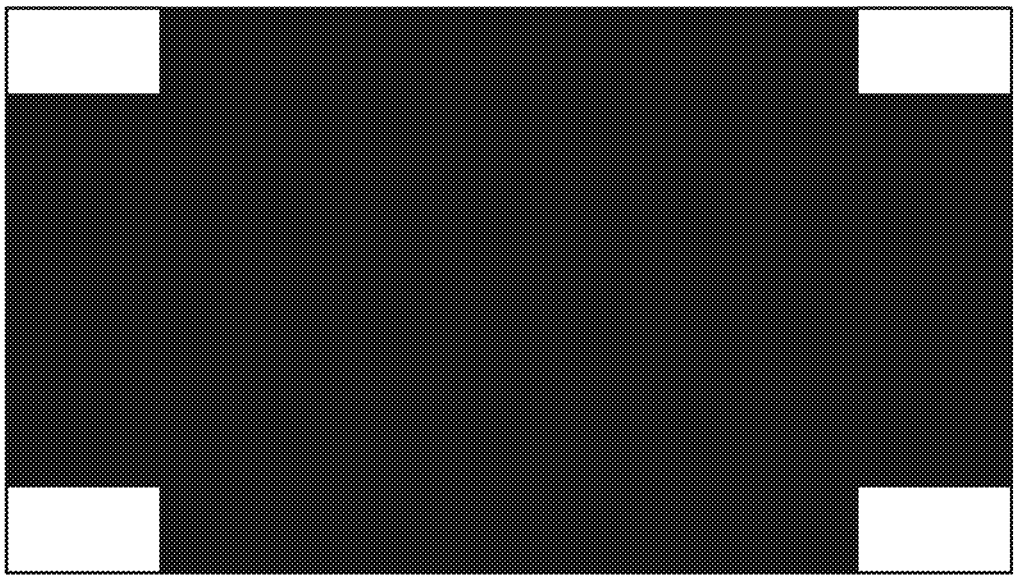
FIG. 8A is a schematic diagram illustrating a second input image input to the liquid crystal display apparatus.

FIG. 9A illustrates an example of values obtained by acquiring the maximum picture level of the input image illustrated in FIG. 8A for each divided region. FIG. 8A illustrates the input image in which white boxes are arranged at four corners of a black image. Each white box has an area corresponding to 2.5% of the area of the input image (the area is hereinafter referred to as a 2.5% area). The aspect ratio of each white box may be equal to or different from the aspect ratio of the input image. As seen from FIG. 9A, the maximum picture level in the region corresponding to the shaded portion (first region) illustrated in FIG. 3B is "0". Accordingly, the first gain of 0.5 is calculated based on the graph illustrated in FIG. 4A. FIG. 9B illustrates an example of values obtained by acquiring the average picture level of the input image illustrated in FIG. 8A for each divided region. As seen from FIG. 9B, the average picture level in the divided regions included in the region corresponding to the shaded portion (second region) illustrated in FIG. 3C is in the range from 0 to 4095, and the maximum value is 4095. Accordingly, the second gain of 0.5 is calculated based on the graph illustrated in FIG. 4B. Thus, the adjustment gain is calculated by 0.5 (first gain)×0.5 (second gain)=0.25 in accordance with Formula (1).

Figure 8B:
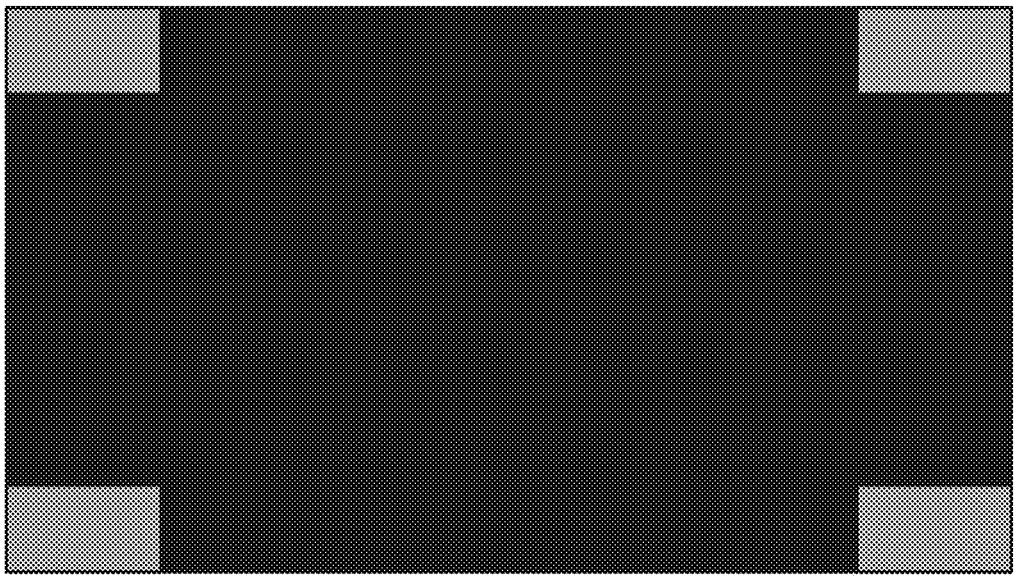
FIG. 8B is a schematic diagram illustrating a second display image displayed on the liquid crystal display apparatus.

FIG. 10A illustrates an example of the backlight control values for displaying the input image illustrated in FIG. 8A. The adjusted backlight control values illustrated in FIG. 10B are obtained through multiplication of the backlight control value illustrated in FIG. 10A by the adjustment gain of 0.25. Thus, even when the backlight light emission luminance at four corners of the screen is high, the backlight light emission luminance is decreased, thus reducing the amount of diffused light from the ends of the screen. FIG. 8B illustrates a display image displayed on the screen of the display apparatus 100 based on data about the input image illustrated in FIG. 8A. The luminance in each of the white boxes arranged at four corners of the display image is reduced. The display apparatus 100 can control the display luminance at a central portion of the display image illustrated in FIG. 8B to be less than or equal to a predetermined luminance by reducing the luminance in each of the white boxes arranged at the four corners as described above. In the present exemplary embodiment, the predetermined luminance is 0.005 nits (in one embodiment, 0.001 nits). The display apparatus 100 is configured to display a display image with a central display luminance of 1000 nits or more in a case where the input image in which a white rectangle having a 10% area is arranged only at the center of a black image is input.

Figure 11:
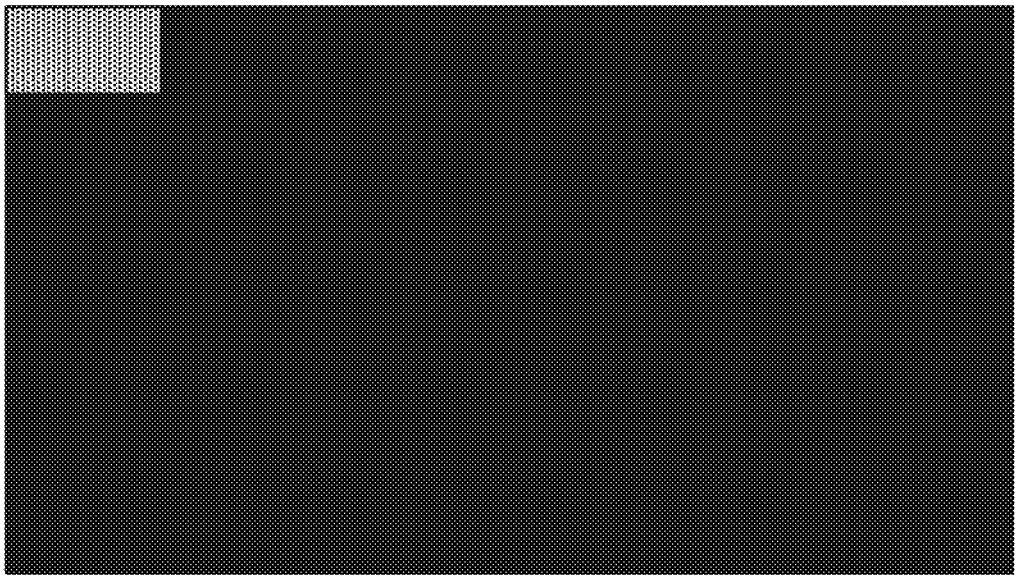
FIG. 11 is a schematic diagram illustrating a third input image input to the liquid crystal display apparatus.

FIG. 12A illustrates an example of values obtained by acquiring the maximum picture level of the input image illustrated in FIG. 11 for each divided region. FIG. 11 illustrates the input image in which a gray box having a 2.5% area is arranged at upper left of a black image. RGB values corresponding to gray are (1024, 1024, 1024). As seen from FIG. 12A, the maximum picture level in the region corresponding to the shaded portion (first region) illustrated in FIG. 3B is "0". Accordingly, the first gain of 0.5 is calculated based on the graph illustrated in FIG. 4A. FIG. 12B illustrates an example of values obtained by acquiring the average picture level of the input image illustrated in FIG. 11 for each divided region. As seen from FIG. 12B, the average picture level in the divided regions included in the region corresponding to the shaded portion (second region) illustrated in FIG. 3C is in a range from 0 to 1024, and the maximum value is 1024. Accordingly, the second gain of 1.0 is calculated based on the graph illustrated in FIG. 4B. In this case, since the second gain is 1.0, the adjustment gain is set to 1.0, regardless of the first gain.

FIG. 13A illustrates a backlight control value for displaying the input image illustrated in FIG. 8A. The backlight control values illustrated in FIG. 13A are each multiplied by the adjustment gain of 1.0, and thus the backlight control values do not vary as illustrated in FIG. 13B. Specifically, in a case where the backlight light emission luminance at an end of the screen is low as illustrated in FIG. 11, the effect of diffused light is small, and thus the backlight light emission luminance is not reduced.

Figure 14:
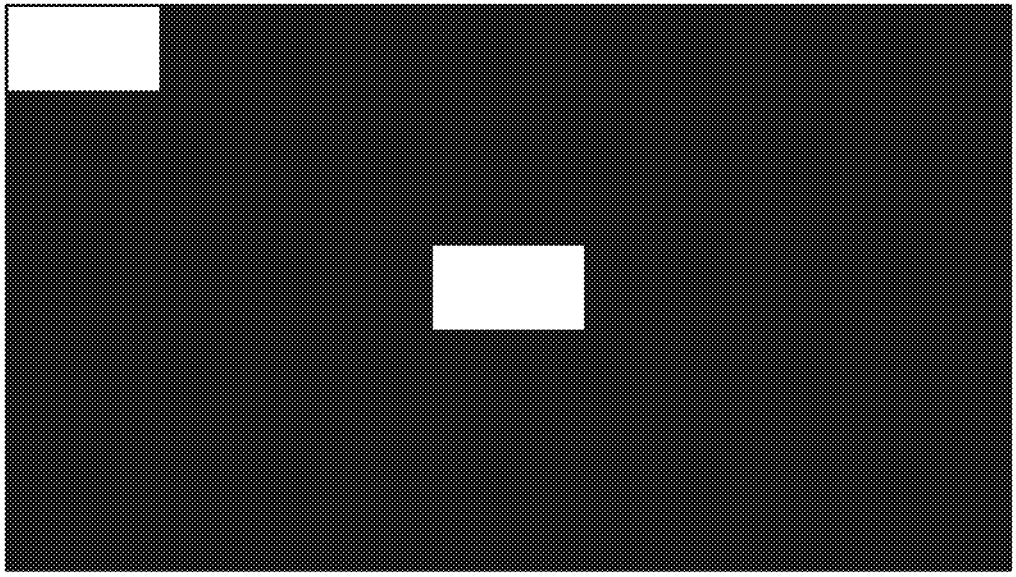
FIG. 14 is a schematic diagram illustrating a fourth input image input to the liquid crystal display apparatus.

FIG. 15A illustrates an example of values obtained by acquiring the maximum picture level of the input image illustrated in FIG. 14 for each divided region. FIG. 14 illustrates the input image in which white boxes each having a 2.5% area are arranged at upper left and at the center of a black image. As seen from FIG. 15A, the maximum picture level in the region corresponding to the shaded portion (first region) illustrated in FIG. 3B is 4095. Accordingly, the first gain of 1.0 is calculated based on the graph illustrated in FIG. 4A. FIG. 15B illustrates an example of values obtained by acquiring the average picture level of the input image illustrated in FIG. 14 for each divided region. As seen from FIG. 15B, the average picture level in the divided regions included in the region corresponding to the shaded portion (second region) illustrated in FIG. 3C is in the range from 0 to 4095, and the maximum value is 4095. Accordingly, the second gain of 0.5 is calculated based on the graph illustrated in FIG. 4B. In this case, since the first gain is 1.0, the adjustment gain is set to 1.0, regardless of the second gain.

FIG. 16A illustrates an example of the backlight control value for displaying the input image illustrated in FIG. 14. The backlight control values illustrated in FIG. 16A are each multiplied by the adjustment gain of 1.0, and thus the backlight control values do not vary as illustrated in FIG. 16B. Specifically, in a case where the luminance at a central portion of the screen is high as illustrated in FIG. 14, the black level fluctuation is not conspicuous and thus there is no need to reduce the black level fluctuation. Thus, the control operation is performed so as not to reduce the backlight light emission luminance.

Figure 24A:
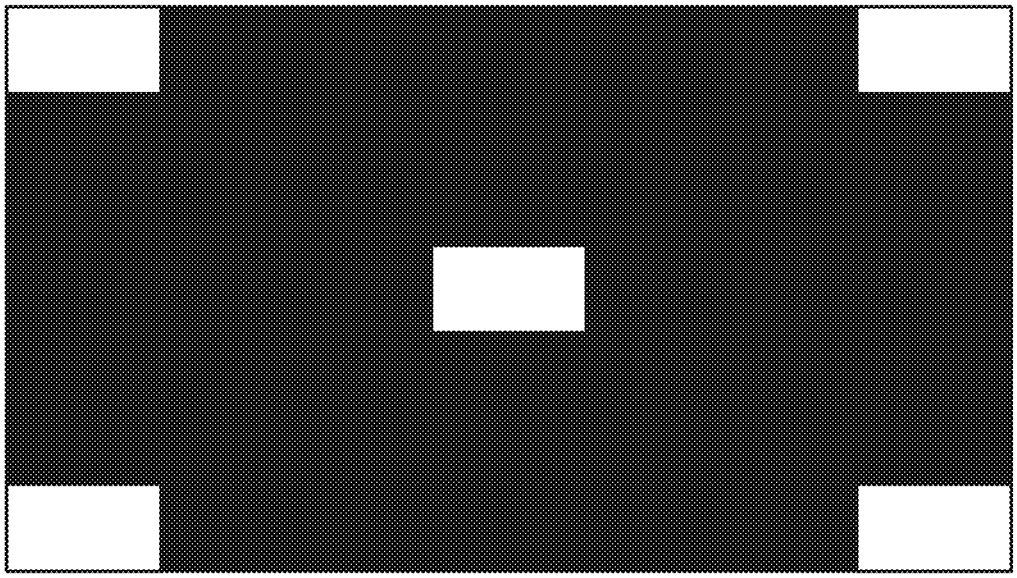
FIG. 24A is a schematic diagram illustrating a fifth input image input to the liquid crystal display apparatus.

FIG. 25A illustrates an example of values by acquiring the maximum picture level of the input image illustrated in FIG. 24A for each divided region. FIG. 24A illustrates the input image in which white boxes each having a 2.5% area are arranged at four corners and at the center of a black image. As seen from FIG. 25A, the maximum picture level in the region corresponding to the shaded portion illustrated in FIG. 3B is 4095. Accordingly, the first gain of 1.0 is calculated based on the graph illustrated in FIG. 4A. FIG. 25B illustrates an example of values obtained by acquiring the average picture level of the input image illustrated in FIG. 24A for each divided region. As seen from FIG. 25B, the average picture level in the divided regions included in the region corresponding to the shaded portion (first region) illustrated in FIG. 3C is in the range from 0 to 4095, and the maximum value is 4095. Accordingly, the second gain of 0.5 is calculated based on the graph illustrated in FIG. 4B. In this case, since the first gain is 1.0, the adjustment gain is set to 1.0, regardless of the second gain.

Figure 24B:
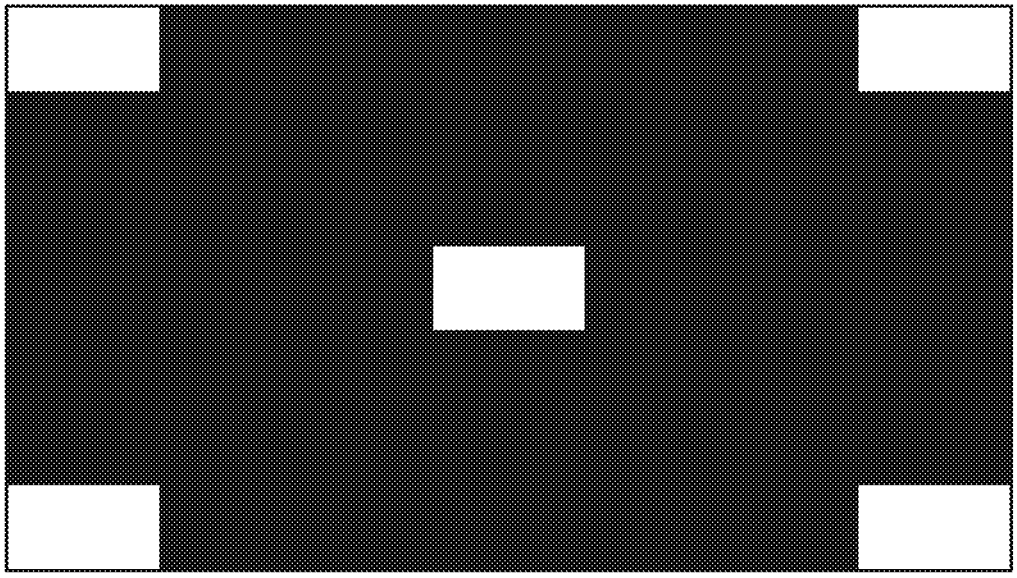
FIG. 24B is a schematic diagram illustrating the fifth input image displayed on the liquid crystal display apparatus.

FIG. 26A illustrates an example of the backlight control value for displaying the input image illustrated in FIG. 24A. The backlight control values illustrated in FIG. 26A are each multiplied by the adjustment value of 1.0, and thus the backlight control values do not vary as illustrated in FIG. 26B. Thus, in a case where the luminance at a central portion of the screen is high as illustrated in FIG. 24A, there is no need to reduce the black level fluctuation. Accordingly, the control is performed so as not to reduce the backlight light emission luminance FIG. 24B illustrates a display image displayed on the screen of the display apparatus 100 based on data about the input image illustrated in FIG. 24A. The luminance in each of the white boxes arranged at four corners of the display image illustrated in FIG. 24B is not reduced, unlike in the display image illustrated in FIG. 8B. In other words, the display luminance (maximum value or average value) in each of the white boxes arranged at four corners of the display image illustrated in FIG. 8B is lower than the display luminance (maximum value or average value) in each of the white boxes arranged at four corners of the display image illustrated in FIG. 24B. Assume a case where each of a plurality of input images in which RGB values in only a white box located at the center of the display image among five white boxes illustrated in FIG. 24A are gradually decreased and the maximum picture level (or average luminance level) in the white box are gradually decreased is input to the display apparatus 100. In such a case, for a typical display apparatus, only the display luminance in the white box located at the center of the display image is gradually decreased. However, for the display apparatus 100 according to the present exemplary embodiment, not only the display luminance (maximum value or average value) in the white box located at the center of the display image illustrated in FIG. 24B, but also the display luminance (maximum value or average value) in each of the white boxes located at four corners is gradually decreased.

As described above, the liquid crystal display apparatus according to the first exemplary embodiment is configured to reduce the backlight light emission luminance in a region of non-interest, such as an end of the screen, in a case where an image in a region of interest, such as a central portion of the screen, is dark. Thus, it is possible to control an increase in the backlight light emission luminance at an end of the screen and to reduce the black level fluctuation due to light diffusion.

Second Exemplary Embodiment

The first exemplary embodiment described above illustrates an example where the backlight control value is multiplied by the adjustment gain, thus controlling an increase in the backlight light emission luminance and reducing the black level fluctuation due to light diffusion. A second exemplary embodiment illustrates an example where the backlight control value is limited to control an increase in the backlight light emission luminance.

Figure 17:
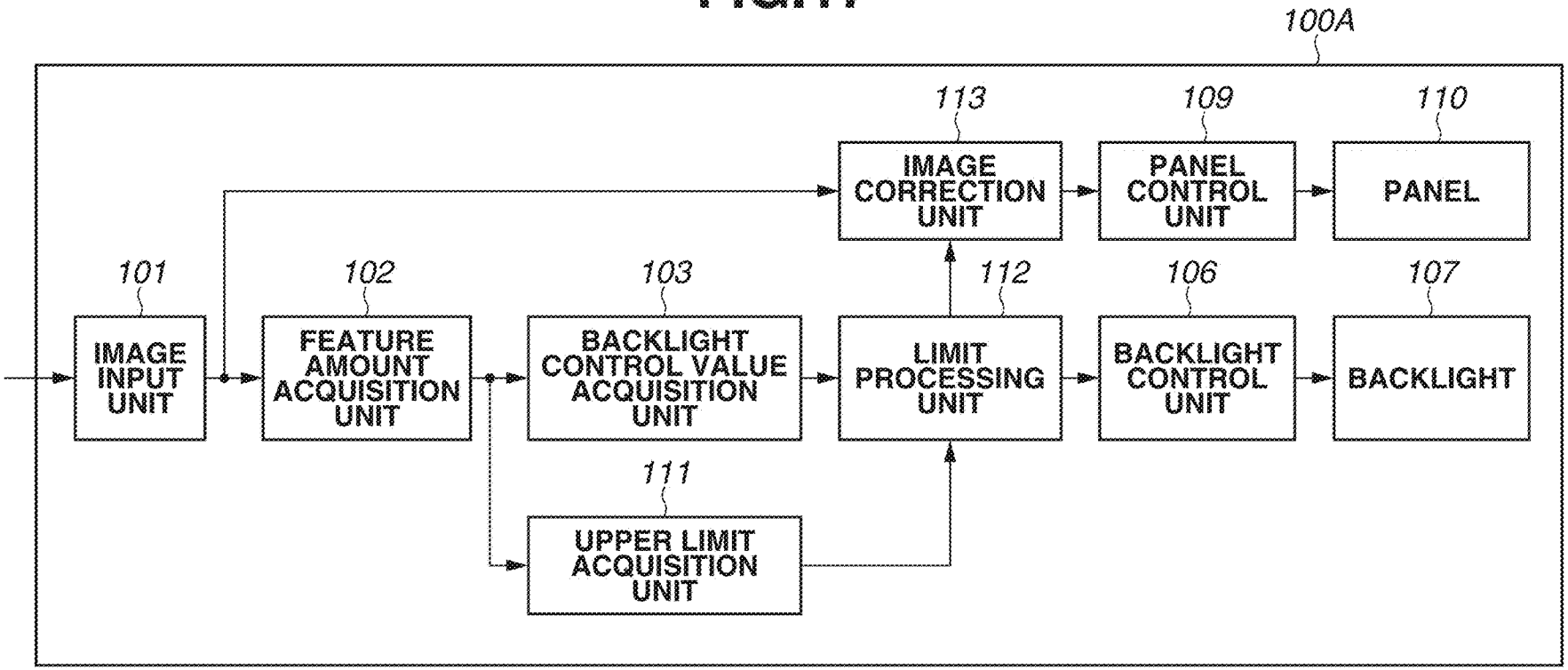
FIG. 17 is a block diagram illustrating functional blocks of a liquid crystal display apparatus according to a second exemplary embodiment.

FIG. 17 is a block diagram illustrating a display apparatus 100A according to the second exemplary embodiment. Functional blocks that perform an operation different from that of the first exemplary embodiment will be described in detail below.

An upper limit acquisition unit 111 calculates an upper limit of the backlight control value generated by the backlight control value acquisition unit 103 based on the feature amount in the image data acquired by the feature amount acquisition unit 102.

A limit processing unit 112 limits the backlight control value generated by the backlight control value acquisition unit 103 with the upper limit of the backlight control value calculated by the adjustment gain acquisition unit 104. The backlight control value limited by the limit processing unit 112 is sent to the backlight control unit 106.

An image correction unit 113 corrects the image data acquired by the image input unit 101 based on the backlight control value limited by the limit processing unit 112. Specifically, in a case where the backlight control value limited by the limit processing unit 112 is 0.5 times the backlight control value generated by the backlight control value acquisition unit 103, the image correction unit 113 multiplies the RGB values in the image data by a correction gain of 1/0.5=2. As in the image correction unit 108 according to the first exemplary embodiment, the correction gain may be adjusted so that the RGB values in the image data do not exceed the maximum gradation value.

Figure 18:
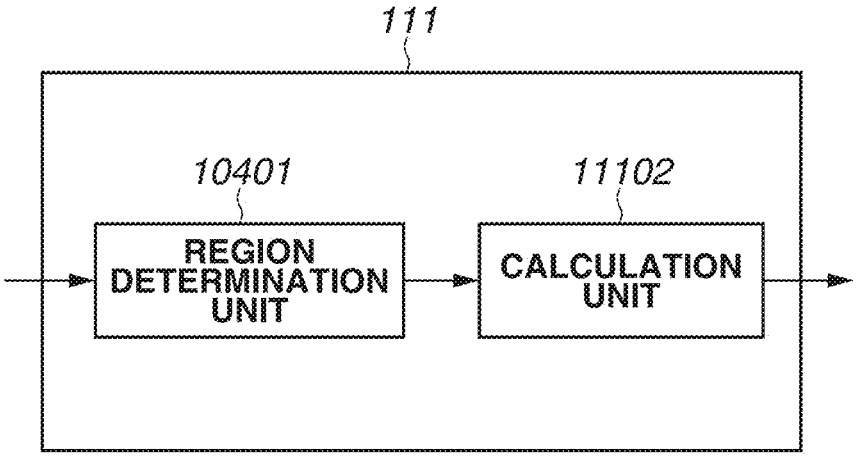
FIG. 18 is a block diagram illustrating functional blocks of an upper limit acquisition unit according to the second exemplary embodiment.

FIG. 18 is a block diagram illustrating functional blocks of the upper limit acquisition unit 111.

As in the first exemplary embodiment, the region determination unit 10401 determines whether each of the divided regions from which the feature amount is acquired by the feature amount acquisition unit 102 illustrated in FIG. 17 corresponds to the first region or the second region.

Figure 19:
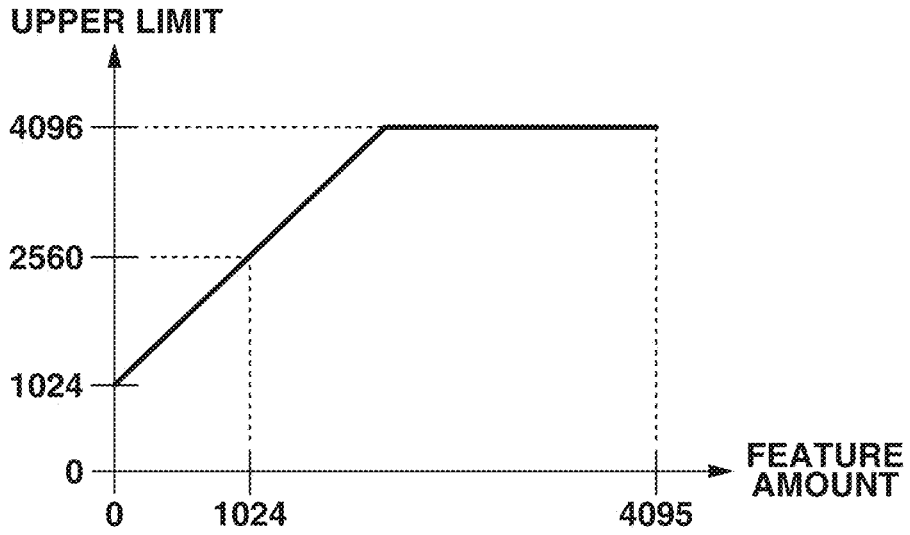
FIG. 19 is a graph schematically illustrating a relationship between a feature amount of image data and an upper limit of a backlight control value.

A calculation unit 11102 calculates an upper limit based on the feature amount in the first region. Here, the black level fluctuation is to be reduced in the first region. Accordingly, as illustrated in FIG. 19, as the feature amount of in the first region decreases, the upper limit is set to a smaller value. The feature amount used by the calculation unit 11102 is the maximum picture level in the entire region corresponding to the shaded portion (first region) illustrated in FIG. 3B. Any feature amount may be used as long as the feature amount indicates the luminance in data about an input image. Alternatively, for example, the average picture level in the entire first region, or the maximum value of the average picture level in the divided region determined to be the first region may be used.

A specific example of backlight control value limiting processing will be described.

FIG. 6A illustrates an example of values obtained by acquiring the maximum picture level of the input image illustrated in FIG. 5 for each divided region. As seen from FIG. 6A, the maximum picture level in the region corresponding to the shaded portion illustrated in FIG. 3B is "0". Accordingly, the upper limit of 1024 is calculated based on a graph illustrated in FIG. 19. FIG. 20A illustrates backlight control values for displaying the image data illustrated in FIG. 11. The backlight control values illustrated in FIG. 20B are obtained by limiting the backlight control value illustrated in FIG. 20A to the upper limit of 1024.

FIG. 9A illustrates an example where the maximum picture level of the input image illustrated in FIG. 8A is acquired for each divided region. As seen from FIG. 9A, the maximum picture level in the region corresponding to the shaded portion illustrated in FIG. 3B is "0". Accordingly, the upper limit of 1024 is calculated based on the graph illustrated in FIG. 19. FIG. 21A illustrates a backlight control value for displaying the input image illustrated in FIG. 8A. The backlight control value illustrated in FIG. 21B is obtained by limiting the backlight control value illustrated in FIG. 21A to the upper limit of 1024.

Thus, the limiting of the backlight control value to the upper limit prevents a reduction in the luminance as compared with the case of gain adjustment, while controlling an increase in the backlight light emission luminance at an end of the screen. FIG. 8B illustrates a display image displayed on the screen of the display apparatus 100A based on data about the input image illustrated in FIG. 8A. The luminance in each of the white boxes arranged at four corners of the display image is decreased. The display apparatus 100A can control the display luminance in the center of the display image illustrated in FIG. 8B at less than or equal to 0.005 nits (in one embodiment, more than or equal to 0.001 nits) by reducing the luminance in each of the white boxes arranged at the four corners. The display apparatus 100A is configured to display a display image with a central display luminance of 1000 nits or more when the input image in which a white rectangle having a 10% area is arranged only at the center of the black image is input.

FIG. 12A illustrates an example of values obtained by acquiring the maximum picture level of the input image illustrated in FIG. 11 for each divided region. As seen from FIG. 12A, the maximum picture level in the region corresponding to the shaded portion illustrated in FIG. 3B is "0". Accordingly, the upper limit of 1024 is calculated based on the graph illustrated in FIG. 19. FIG. 22A illustrates backlight control values for displaying the input image illustrated in FIG. 11. Since a maximum backlight control value illustrated in FIG. 22A is 1024, even when the backlight control values are each limited to the upper limit of 1024, the backlight control values do not vary before and after the limit processing as illustrated in FIG. 22B. In other words, the adverse effect of a reduction in luminance can be reduced in a dark region of image data.

FIG. 15A illustrates an example of values obtained by acquiring the maximum picture level of the input image illustrated in FIG. 14 for each divided region. As seen from FIG. 15A, the maximum picture level in the region corresponding to the shaded portion illustrated in FIG. 3B is "4095". Accordingly, the upper limit of 4096 is calculated based on the graph illustrated in FIG. 19. FIG. 23A illustrates backlight control values for displaying the input image illustrated in FIG. 14. Since a maximum backlight control value illustrated in FIG. 23A is 4096, even when the backlight control values are each limited to the upper limit of 4096, the backlight control values do not vary before and after the limit processing as illustrated in FIG. 23B. Specifically, in a case where the display luminance in image data at a central portion of the screen is high, the upper limit for the limit processing is set to a high level, thus controlling a reduction in the backlight light emission luminance.

FIG. 25A illustrates an example of values obtained by acquiring the maximum picture level of the input image illustrated in FIG. 24A for each divided region. As seen from FIG. 25A, the maximum picture level in the region corresponding to the shaded portion illustrated in FIG. 3B is "4095". Accordingly, the upper limit of 4096 is calculated based on the graph illustrated in FIG. 19. FIG. 27A illustrates backlight control values for displaying the input image illustrated in FIG. 24A. Since a maximum backlight control value illustrated in FIG. 27A is 4096, even when the backlight control value is limited to the upper limit of 4096, the backlight control values do not vary before and after the limit processing as illustrated in FIG. 27B. Specifically, in a case where the display luminance in image data at a central portion of the screen is high, the upper limit for the limit processing is set to a high level, thus controlling a reduction in the backlight light emission luminance.

FIG. 24B illustrates a display image displayed on the screen of the display apparatus 100A based on data about the input image illustrated in FIG. 24A. Unlike in the display image illustrated in FIG. 8B, the luminance in each of the white boxes arranged at four corners of the display image illustrated in FIG. 24B is not reduced. In other words, the display luminance (maximum value or average value) in each of the white boxes arranged at four corners of the display image illustrated in FIG. 8B is lower than the display luminance (maximum value or average value) in each of the white boxes arranged at four corners of the display image illustrated in FIG. 24B. Assume a case where each of the plurality of input images in which RGB values in only a white box located at the center of the display image among five white boxes in the input image illustrated in FIG. 24A are gradually decreased and the maximum picture level (or the average luminance level) in the white box is gradually decreased is input to the display apparatus 100A. In such a case, for a typical display apparatus, only the display luminance in the white box located at the center of the display image is gradually decreased. However, for the display apparatus 100A according to the present exemplary embodiment, not only the display luminance (maximum value or average value) in the white box located at the center of the display image illustrated in FIG. 24B, but also the display luminance (maximum value or average value) in each of the white boxes arranged at the four corners is gradually decreased.

As described above, the liquid crystal display apparatus according to the present exemplary embodiment is configured to limit the backlight light emission luminance in a case where an image in image data in a region of interest, such as a central portion of the screen, is dark. This controls an increase in the backlight light emission luminance only in the region in which light is emitted with high luminance, thus reducing the black level fluctuation due to light diffusion. In addition, the adverse effect of the backlight light emission luminance can be reduced in a dark region of image data.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

The above-described exemplary embodiments illustrate an example where a central region of the screen is set to a region of interest (first region) and a peripheral region of the screen is set to a region of non-interest (second region). Alternatively, any region designated by a user may be set to the region of interest (first region), and a region other than the designated region may be set to the region of non-interest (second region).

This application claims the benefit of Japanese Patent Application No. 2019-152797, filed Aug. 23, 2019, which is hereby incorporated by reference herein in its entirety.

What is claimed is:

1. An apparatus that displays a display image based on data about an input image, the apparatus comprising:

a controller configured to perform local dimming control based on the data about the input image, wherein, in a case where the input image is a black image in which white boxes each having an area corresponding to approximately 2.5% of the input image are arranged only at a center and four corners of the input image, the controller displays, with a first display luminance, regions at four corners of the display image corresponding to the white boxes at the four corners of the input image, and wherein, in a case where the input image is a black image in which the white boxes are arranged only at the four corners of the input image, the controller displays the regions at the four corners of the display image with a second display luminance lower than the first display luminance so that a display luminance at the center of the display image is lower than or equal to 0.001 nits.

2. The apparatus according to claim 1, wherein, in a case where the input image is a black image in which a white rectangle having an area corresponding to approximately 10% of the input image is arranged at a central portion of the input image, the controller performs control such that a display luminance at the central portion of the display image is greater than or equal to approximately 1000 nits.

3. A method for controlling an apparatus that displays a display image based on data about an input image, the method comprising:

performing local dimming control based on the data about the input image, wherein, in a case where the input image is a black image in which white boxes each having an area corresponding to approximately 2.5% of the input image are arranged only at a center and four corners of the input image, regions at four corners of the display image corresponding to the white boxes at the four corners of the input image are displayed with a first display luminance, and wherein, in a case where the input image is a black image in which the white boxes are arranged only at the four corners of the input image, the regions at the four corners of the display image are displayed with a second display luminance lower than the first display luminance so that a display luminance at the center of the display image is lower than or equal to 0.001 nits.

4. A non-transitory computer-readable storage medium storing a program for causing a computer to execute a method for controlling an apparatus that displays a display image based on data about an input image, the method comprising:

performing local dimming control based on the data about the input image, wherein, in a case where the input image is a black image in which white boxes each having an area corresponding to approximately 2.5% of the input image are arranged only at a center and four corners of the input image, regions at four corners of the display image corresponding to the white boxes at the four corners of the input image are displayed with a first display luminance, and wherein, in a case where the input image is a black image in which the white boxes are arranged only at the four corners of the input image, the regions at the four corners of the display image are displayed with a second display luminance lower than the first display luminance so that a display luminance at the center of the display image is lower than or equal to 0.001 nits.

* * * * *